US006001516A

United States Patent [19]

Gasper

[11] Patent Number: 6,001,516

[45] **Date of Patent: *Dec. 14, 1999**

[54] COPY RESTRICTIVE COLOR-NEGATIVE PHOTOGRAPHIC PRINT MEDIA

[75] Inventor: John Gasper, Hilton, N.Y.

[73] Assignee: Eastman Kodak Company, Rochester, N.Y.

[ * ] Notice: This patent is subject to a terminal disclaimer.

[21] Appl. No.: 08/873,959

[22] Filed: Jun. 12, 1997

[51] Int. Cl.[6] ..... G03C 1/76; B42D 15/00

[52] U.S. Cl. ..... 430/10; 283/902; 283/93; 399/366

[58] Field of Search ..... 430/10; 283/902, 283/93; 399/366

[56] References Cited

U.S. PATENT DOCUMENTS

| | | | |
|---|---|---|---|
| 5,018,767 | 5/1991 | Wicker | 283/67 |
| 5,193,853 | 3/1993 | Wicker | 283/85 |
| 5,231,663 | 7/1993 | Earl et al. | 380/18 |
| 5,379,093 | 1/1995 | Hashimoto et al. | 399/366 |
| 5,390,003 | 2/1995 | Yamaguchi et al. | 399/366 |
| 5,412,718 | 5/1995 | Narasimhalu et al. | 380/4 |
| 5,444,779 | 8/1995 | Daniele | 380/3 |
| 5,636,292 | 6/1997 | Rhoads | 382/232 |
| 5,710,834 | 1/1998 | Rhoads | 382/232 |
| 5,745,604 | 4/1998 | Rhoads | 382/232 |
| 5,748,763 | 5/1998 | Rhoads | 382/115 |
| 5,748,783 | 5/1998 | Rhoads | 382/232 |
| 5,752,152 | 5/1998 | Gasper et al. | 399/366 |
| 5,768,426 | 6/1998 | Rhoads | 382/232 |
| 5,772,250 | 6/1998 | Gasper | 283/114 |
| 5,822,436 | 10/1998 | Rhoads | 380/54 |
| 5,832,119 | 11/1998 | Rhoads | 382/232 |
| 5,841,886 | 11/1998 | Rhoads | 382/115 |
| 5,841,978 | 11/1998 | Rhoads | 395/200.47 |
| 5,843,564 | 12/1998 | Gasper et al. | 428/211 |
| 5,850,481 | 12/1998 | Rhoads | 382/232 |

OTHER PUBLICATIONS

Jaromir Kosak, "Light–Sensitive Systems, Chemistry and Application of Nonsilver Halide Photographic Processes" *Wiley Series on Photographic Science and Technology and the Graphic Arts*,1965, pp. 386–397.

D.M. Sqick, "Critical Densities for Graininess in Reflection Prints" *Journal of Applied Photographic Engineering*, vol. 8, No. 2, Apr. 1982, pp. 71–76.

Heinrich Niemann, *Pattern Analysis and Understanding*, Second Edition, Springer–Verlag Berlin Heidelberg, New York, pp. 188–189.

E.N. Willmer and W.D. Wright, "Colour Sensitivity of the Fovea Centralis" *Nature*, No. 3952, Jul. 28, 1945, pp. 119–121.

R.W.G. Hunt, *The Reproduction of Colour in Photography, Printing & Television*, 1987, Fountain Press, England, pp. 12–13, and pp. 118–119.

Research Disclosure No. 365, Sep. 1994, pp. 501–541.

J. Serra, *Image Analysis and Mathematical Morphology*, vol. 1 Academic Press, 1982, pp. 424–445.

Joseph W. Goodman, *Introduction to Fourier Optics*,McGraw–Hill Book Company, 1968, pp. 176–183.

William K. Pratt, *Digital Image Processing*, Second Edition, Wiley–Interscience Publication, John Wiley & Sons, Inc. 1991, pp. 613–614.

*Primary Examiner*—Mark F. Huff

*Attorney, Agent, or Firm*—Edward Dugas; Mark G. Bocchetti

[57] ABSTRACT

A color-negative photographic print medium for restricting the copying of an image in the medium utilizing a pattern of removable color-subtractive microdots depth-wise positioned anywhere within a transparent protective overcoat and a support layer which supports at least one image-forming layer is disclosed. The microdots are undetectable by the unaided eye, but detectable by copying machines programmed to prevent copying when microdots are detected.

42 Claims, 9 Drawing Sheets

COPY RESTRICTIVE COLOR-NEGATIVE PHOTOGRAPHIC PRINT MEDIA

CROSS-REFERENCE TO RELATED APPLICATIONS

The present application is related to U.S. patent application Ser. No. 60/004,404, filed Sep. 28, 1995, by Jay S. Schildkraut, et al., and entitled, "Copy Protection System;" U.S. Pat. No. 5,752,152, filed Feb. 8, 1996, by John Gasper, et al., and entitled, "Copy Restrictive System;" U.S. patent application Ser. No. 08/598,785, filed Feb. 8, 1996, by John Gasper, et al., and entitled, "Copy Restrictive Documents;" U.S. Pat. No. 5,822,660, filed Feb. 8, 1996, by Xin Wen, and entitled, "Copyright Protection In Color Thermal Prints;" U.S. patent application Ser. No. 08/837,931, by John Gasper, et al., and entitled "Copy Restrictive System for Color-Reversal Documents;" and U.S. Pat. No. 5,772,250, by John Gasper and entitled "Copy Restrictive Color-Reversal Documents." The last two applications were filed on even date Apr. 10, 1997.

FIELD OF THE INVENTION

The invention relates generally to the field of copy restriction, and in particular to a technique for making copy restricted color-negative photographic prints.

BACKGROUND OF THE INVENTION

Copying of documents has been performed since the first recording of information in document form. Documents are produced using many procedures on many types of substrates incorporating many forms of information. Unauthorized copying of documents has also been occurring since the storage of information in document form first began. For much of the history of information documentation the procedures used to copy original documents have been sufficiently cumbersome and costly to provide a significant impediment to unauthorized copying, thus limiting unauthorized copying to original documents of high value (e.g. currency, etc.). However, in more recent times the introduction of new technologies for generating reproductions of original documents (e.g. electrophotography, etc.) has decreased the cost and inconvenience of copying documents, thus increasing the need for an effective method of inhibiting unauthorized copying of a broader range of restricted documents. The inability of convenient, low cost copying technologies to copy original documents containing color or continuous tone pictorial information restricted unauthorized copying primarily to black-and-white documents containing textual information and line art. Recently, the introduction of cost effective document scanning and digital methods of signal processing and document reproduction have extended the ability to produce low cost copies of original documents to documents containing color and high quality pictorial information. It is now possible to produce essentially indistinguishable copies of any type of document quickly, conveniently, and cost effectively. Accordingly, the problem of unauthorized copying of original documents has been extended from simple black-and-white text to color documents, documents containing pictorial images, and photographic images. In particular, restricting the unauthorized duplication of photographic images produced by professional photographers on digital copying devices has recently become of great interest.

U.S. Pat. No. 5,193,853 by Wicker, and U.S. Pat. No. 5,018,767 by Wicker, disclose methods for restricting the unauthorized copying of original documents on devices utilizing opto-electronic scanning by incorporating spatially regular lines into the document. The spacings of the lineations incorporated in the original document are carefully selected to produce Moiré patterns of low spatial frequency in the reproduced document allowing it to be easily distinguished from the original and degrading the usefulness of the reproduction. Although the Moiré patterns produced in the reproduced document are readily apparent to an observer, the required line pattern incorporated in the original document to produce the Moiré pattern upon copying is also apparent to an observer. Additionally, production of the Moiré pattern in the reproduced document requires specific scanning pitches be employed by the copying device. Accordingly, this method of restricting unauthorized document copying is applicable only to documents such as currency or identification cards where the required line pattern can be incorporated without decreasing the usefulness of the document. Application of this technique to high quality documents is unacceptable due to the degradation of quality and usefulness of the original document.

U.S. Pat. No. 5,444,779 by Daniele, discloses a method of restricting a document from unauthorized copying by the printing of a two-dimensional encoded symbol in the original document. Upon scanning of the original document in an initial step of a copying process, the encoded symbol is detected in the digital representation of the original document and the copying process is either inhibited or allowed following billing of associated royalty fees. U.S. patent application Ser. No. 08/593,772, filed Jan. 29, 1996, by Schildkraut et al., and entitled, "Copy Protection System," discloses the incorporation of a symbol of a defined shape and color into a document followed by detection of the symbol in a scanned representation of the document produced by the copying device. In both disclosures, the incorporated symbol is detectable by an observer and readily defeated by cropping the symbol from the original document prior to copying. In addition, incorporation of the symbol into the document is required in the generation of the original document leading to undesired inconvenience and additional cost. Accordingly, these methods of imparting restriction from unauthorized copying are unacceptable.

U.S. Pat. No. 5,390,003 by Yamaguchi, et al., U.S. Pat. No. 5,379,093 by Hashimoto, et al., and U.S. Pat. No. 5,231,663 by Earl, et al. disclose methods of recognizing a copy restricted document by the scanning and analysis of some portion of the original document and comparison of the signal obtained with the signals stored in the copying device. When the signal of a copy restricted document is recognized, the copying process is inhibited. This method of restricting from the unauthorized copying of documents is limited in application because the signals of all documents to be copy restricted must be stored in or accessible by each copying device of interest. Because the number of potential documents to be restricted is extremely large and always increasing, it is impractical to maintain an updated signature database in the copying devices of interest.

Methods of encrypting a digital signal into a document produced by digital means have been disclosed. These methods introduce a signal which can be detected in a copying system utilizing document scanning and signal processing. These methods offer the advantage of not being detectable by an observer, thus maintaining the usefulness of high quality restricted documents. However, implementation of these methods is dependent on digital production of original documents. Although increasing, production of high quality documents using digital means is still limited. Accordingly, this approach is not useful for restricting the unauthorized copying of high quality documents produced using non-digital production methods.

U.S. Pat. No. 5,412,718, by Narasimhalu, et al. discloses the use of a key associated with the physical properties of the document substrate which is required to decode the encrypted document. This method of restricting the unauthorized copying of documents is unacceptable for applications of interest to the present invention because it requires encryption of the original document, rendering it useless prior to decoding.

U.S. Pat. No. 5,752,152, filed Feb. 8, 1996, by John Gasper, et al., and entitled, "Copy Restrictive System" and U.S. patent application Ser. No. 08/598,785, also filed on Feb. 8, 1996, by John Gasper, et al., and entitled, "Copy Restrictive Documents" disclose pre-exposing color photographic paper to spots of blue light to produce an array of yellow microdots after chemical processing and a method of detecting these microdots in the end user's image during scanning performed by a digital printing device. Color photographic paper capable of forming yellow microdots after exposure to spots of blue light is of the color-negative type. The yellow microdots are most easily detected in areas of the image of low reflection density in all color records, usually referred to as the highlight areas, and for this reason they need to be exposed so as to form yellow microdots of low reflection density. If, however, their reflection density is made too low then the scanner of the digital copying device may be unable to detect them in typical scenes having a wide range of reflection densities. This sets tight tolerances on the acceptable range of microdot densities.

U.S. patent application Ser. No. 08/837,931, by John Gasper, et al. and entitled "Copy Restrictive System for Color-Reversal Documents" and U.S. Pat. No. 5,772,250, by John Gasper and entitled "Copy Restrictive Color-Reversal Documents," both filed on Apr. 10, 1997, disclose using color-reversal photographic media to create copy restrictive documents. Exposure of color-reversal photographic media to microdots of blue light prior to or after recording of the image exposure produces imperceptible (but scanner detectable) microdots after photographic processing. In areas of the scene of very low reflection density (highlight areas), however, there are no microdots present. It is therefore possible to form microdots in the recorded image that offer excellent detection by a digital copier in a region of reflection densities where they are not visually detectable. The advantages of improved scanner detectability and improved invisibility offered by employing color-reversal photographic media cannot be achieved in color-negative photographic media when the microdots are created by light exposure.

SUMMARY OF THE INVENTION

The present invention is directed to overcoming one or more of the problems set forth above for documents prepared from color-negative photographic print media. Briefly summarized, according to one aspect of the present invention, there is provided a copy restrictive color-negative photographic print medium comprising: a support layer; at least one image-forming layer supported by said support layer; a clear protective overcoat above said at least one image-forming layer; and a pattern of removable color-subtractive microdots depth-wise positioned anywhere within said protective overcoat and said at least one image-forming layer.

The primary object of the present invention is to produce a document wherein the pattern of removable color-subtractive microdots renders the document copy restrictive when an image is recorded in the medium and the medium is chemically processed to form the document.

A further object of the present invention is to provide a copy restrictive medium that incorporates a plurality of removable color-subtractive microdots present in the medium prior to recording a latent image and absent after chemical processing of the medium to develop the latent image to a visible image.

Another object of the present invention is to provide a copy restrictive medium that incorporates a plurality of permanent microdots in the image of the chemically processed medium that result from the spatial and spectral modulation of image exposure caused by the presence of the removable color-subtractive microdots.

An additional object of the present invention is to provide a copy restrictive medium that incorporates a plurality of permanent microdots in the image of the chemically processed medium with the same pattern as the removed color-subtractive microdots.

An additional object of the present invention is to provide a copy restrictive medium that incorporates a plurality of permanent microdots in the image of the chemically processed media that are substantially invisible.

An additional object of the present invention is to provide a copy restricted medium that incorporates a plurality of permanent microdots in the image of the media that are detectable by an opto-electronic scanning device only within a limited range of reflection densities.

Another object of the present invention is to provide a copy restricted medium that incorporates a plurality of permanent microdots that are not present in the image of the chemically processed medium in the highlight areas.

Still another object of the present invention is the assignment of a unique pattern to the plurality of permanent microdots.

Another object of the present invention is to provide a photographic medium that is rendered copy restrictive without degrading the image quality of the medium.

Another object of the present invention is to provide a method of copy restriction that does not require the use of digital techniques.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

Copy restrictive documents formed by the color-negative print medium of the present invention have several positive features not offered by the copy restrictive color-negative photographic medium of the prior inventions cited above in U.S. Pat. No. 5,752,152 and U.S. patent application Ser. No. 08/598,785, both filed on Feb. 8, 1996. By applying to the image recording medium a pattern of removable microdots prior to its use in recording an image, the pattern of microdots is present during image exposure and the presence of these microdots composed of a removable colorant causes the image exposure to be spatially and spectrally modulated. These removable microdots are subsequently removed, for example, during chemical processing of the medium to render the latent image visible. Their prior presence, however, is permanently recorded in the image as a reduced image density in preferably one of the color records of the image. The recorded image of the removable microdots in the chemically processed media produces a pattern of permanent microdots with the same spatial arrangement. By appropriate selection of the spatial arrangement as well as the color and the optical density of the removable microdots it is possible to form in the chemically processed medium a permanent microdot pattern which is not visible to the user under routine conditions of viewing. Such an invisible pattern can be used in high quality documents without any detectable degradation in the usefulness of the document. The permanent microdot pattern can be employed throughout the document, thereby increasing the robustness of detection, while simultaneously making it impossible to crop out of the document. Additionally, because the permanent microdot pattern is substantially invisible, authorized copying of the original document results in reproductions of high quality and utility. The inventive copy restrictive documents represent a low cost solution to manufacturers of copying devices incorporating opto-electronic scanning devices and digital signal processing since no new equipment is required. The ability to incorporate the removable microdot pattern into the media during its manufacture makes it simple and cost effective for the producer of the media to implement. Furthermore, areas of the image receiving little or no exposure also receive little or no modulation by the removable microdots. Consequently, these highlight areas of the image are without any visible or scanner detectable permanent microdots. This is very advantageous because it is the highlight areas of the image that are most critically examined by professional photographers for artifacts. Another advantageous feature of the present invention is the ability to increase the amount of image modulation accompanying the permanent microdots since they are absent from the highlight areas. The microdots of the prior cited applications become visible in the highlight areas of the image if formed with the same degree of increased image modulation.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
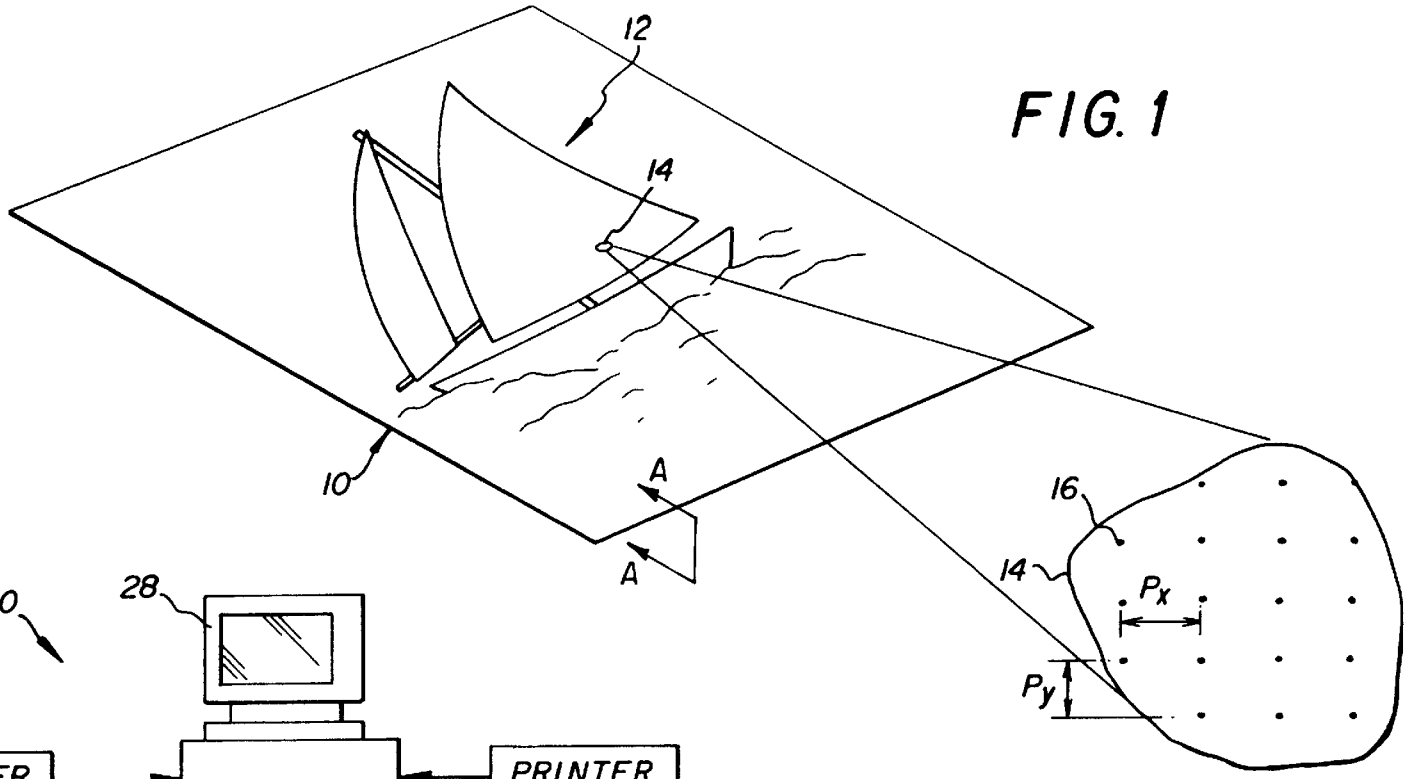
FIG. 1 is a perspective of a photographic print incorporating the microdots of the present invention with an enlarged projection of a portion of the print to visually present the microdots.

Referring to FIG. 1, in its most general implementation, the inventive method to impart copy restriction to hard copy information-bearing documents incorporates a pattern of resultant image microdots 16 into an image 12 on an original document 10. The pattern is enlarged for the reader's ease of viewing in window 14, but normally the pattern is not easily detectable by visual examination of the image 12.

Figure 2:
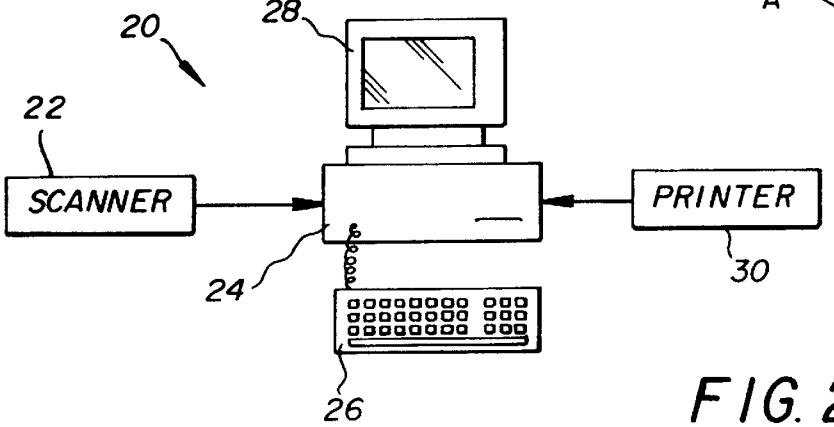
FIG. 2 illustrates in block diagram form a system on which the present method may be incorporated.

FIG. 2 illustrates the arrangement of a typical copy print station 20. In a classical copy situation the original document 10 of FIG. 1 is placed on the bed of a scanner 22 to provide a digitized sequence of scanner signals to a digital image processing unit 24 that incorporates a keyboard 26, touch screen and/or mouse, for operator interfacing and a monitor 28 for viewing the scanned image. A printer 30 is directly attached to the digital image processing unit 24 or is attached via a communication link. With either configuration the printer 30 forms hard copy prints. An algorithm or the like, residing in the digital image processing unit 24, detects the presence of the pattern of resultant image microdots 16 in the original document 10, and automatically deactivates the printer 30 to abort the document copying process thereby restricting the unauthorized copying of the original document 10.

For the purpose of this disclosure, "hard copy, information-bearing documents" (henceforth referred to as "documents") is meant to refer to any type of sheet media, bearing or capable of bearing, any type of visible information. The "sheet media" may be any reflective medium (e.g. paper, opaque plastic, canvas, etc.), or alternatively may be any transparent or translucent medium (e.g. photographic film, etc.). In this disclosure, "information" is meant to refer to any form of information that is visible to the observer. Typical information is either pictorial or graphical in form including, but not limited to, text, sketches, graphs, computer graphics, pictorial images, paintings, and other forms of two-dimensional art. "Original" in this disclosure is meant to refer to the document that is scanned in an initial step of the copying process. "Copy" means a reproduction, likeness, duplication, imitation, semblance that may be magnified or demagnified, whole or part of, in the form of a print, display, digital image file, depiction, or representation. "Scanning" is meant to refer to any opto-electronic means for converting an "original" to corresponding electronic signals. "Copy restriction" means prevention of copying by mechanical, electrical, optical, or other means including the degradation of the usefulness of any copied image as well as controlled enabling of document reproduction with proper authorization.

In the preferred embodiment of the invention, the resultant image microdot pattern is incorporated throughout the document to be copy restricted. Microdot placement at all locations within the document insures that the pattern will exist in at least one important area of the document making it impossible to remove the pattern by physical cropping without significantly decreasing the usefulness of any copied document. In another preferred form of the invention the resultant image microdot pattern is incorporated into the document in a pre-selected location or locations not covering the entire document.

In the practice of this invention, there are two types of microdot patterns with the same spatial arrangement, but the patterns do not co-exist. There is the pattern of removable microdots capable of spectrally and spatially modulating the exposure of the users image and capable of being removed prior to, during, or after photographic chemical processing. These removable microdots will also be called "color-subtractive microdots" because they contain a colorant that controllably decreases or subtracts exposure of typically only one of the three primary color recording layers in a color-negative photographic print medium. A result of the built-in spatial and spectral modulation of the users image exposure caused by the presence of the removable color-subtractive microdots is the creation of another type of permanent microdot pattern in the chemically processed image. These permanent microdots, after removal of the color-subtractive microdots from the medium, appear in the image under magnification as microdots of reduced reflection density primarily in one of the three color records and in a spatial pattern that is identical to the spatial pattern of the removable microdots. These permanent microdots will also be referred to as "resultant image microdots" because they are a direct result of the presence of the removable color-subtractive microdots during image exposure and they are a permanent and inseparable part of the recorded image of the document utilizing the same image dye as that of a primary color record. An important distinction between these two types of microdots is that while the color-subtractive microdots are present in a pattern everywhere to modulate exposure and have a single color attributable to the colorant employed, the resultant image microdots are not present in the highlight areas of the image and have a color (when viewed under magnification) that depends on the color of the background image. When describing properties of the microdots that are deemed common to both color-subtractive microdots and resultant image microdots such as their spatial arrangement, they will be referred to as simply microdots In the practice of the invention, the resultant image microdots incorporated into the document can take any of a variety of forms as long as they satisfy the requirements of being substantially undetectable by casual observation under normal conditions of document use and do not decrease the usefulness of the original document. "Casual observation" is meant to refer to observation of the document under conditions relevant to the normal use of the document including the conditions of viewing and illumination. In particular, viewing distances will conform to those for typical utilization of the original document without the use of special image modifying devices (e.g. magnifying optics, colored filters, etc.), and illumination will conform to typical levels of illumination using illumination sources of typical color temperature. "Detection by casual observation" means discrimination of the individual resultant image microdots of the incorporated microdot pattern or a perceived increase in the density, either neutral or colored, of the document.

The invention is implemented using microdots of any regular or irregular shape. In the case of non-circular microdots, the orientation of the microdots can be selected to lie along any angle between 0 and 360 degrees relative to the horizontal axis of the information bearing document as normally viewed. In one preferred embodiment of the invention, the microdots are square in shape. In another form of the invention, the microdots are circular in shape.

In practicing the invention the size of the resultant image microdots is chosen to be smaller than the maximum size at which individual resultant image microdots are perceived sufficiently to decrease the usefulness of the document when viewed under normal conditions of usage. The minimum size of individual resultant image microdots is chosen to be greater than or equal to the size at which the resultant image microdot pattern can be reasonably detected by document scanning devices. A useful measure of the size of the resultant image microdots is to specify the area of an individual resultant image microdot as the diameter of a resultant image microdot having a circular shape of equivalent area (henceforth referred to as the equivalent circular diameter, ECD). In situations where the edge of a resultant image microdot is not sharply defined, the edge is taken to be the isodensity profile at which the density is half the maximum density. In the preferred embodiment of the invention, resultant image microdots of an ECD of less than or equal to 300 microns are utilized. The ECD of the resultant image microdots preferably is greater than or equal to 10 microns, and most preferably is greater than or equal to 50 microns.

One embodiment of the invention incorporates within the document microdots in a periodic pattern, although it is contemplated that the invention can also be practiced with microdots distributed aperiodically or with a combination of periodic and aperiodic microdot distribution. Periodic patterns of microdots appear to be more useful and can take on any periodic spatial arrangement. One embodiment of the invention places the microdots in a rectangular array. A second embodiment of the invention places the microdots in a hexagonal array. The center-to-center spacing of the microdots, defined as the distance between the centroids of two adjacent microdots, is chosen to be any distance greater than or equal to the minimum distance at which an increase in document density occurs which is observed by casual observation to decrease the usefulness of the original document. In one form of the invention, the spacing of the microdots is greater than or equal to 0.5 mm. The robustness of resultant image microdot detection in the document representative digital signal increases with an increase in the number of microdots present in the document. Although it is possible to practice the invention with any microdot spacing that exceeds the minimum spacing for the detection of an unwanted increase in density, the preferred embodiment of the invention incorporates microdots with a spacing similar to the minimum allowable spacing as described above. Another method of practicing the invention utilizes a microdot pattern in which the center-to-center spacing of the microdots is less than 10 mm.

Resultant image microdots useful in the practice of the invention can be of any brightness, hue, and saturation that does not lead to sufficient detection by casual observation which would reduce the usefulness of the original document. To minimize the detectability of individual resultant image microdots, it is preferable to select the hue of the resultant image microdots to be from the range of hues that are least readily resolvable by the human visual system. It is also preferable to select the hue of the resultant image microdots for minimum visibility under conditions of maximum visual contrast to their surround. When incorporated into photographic prints with images typical of professional photographers, it has been found that the areas of most critical interest to the photographer for observing the presence of resultant image microdots are the areas of low reflection density, and more specifically, white areas.

In the embodiment of the present invention, however, there are no visible or scanner detectable resultant image microdots in the areas of minimum reflection density, generally referred to as the highlight areas of the image. In the highlight areas of the scene where there is no or very little image exposure of the color-negative paper, the subtractive microdot has no or very little capability to further reduce image exposure so no resultant image microdot is present or if present it is of sufficiently low reflection density as to be invisible and undetectable by the scanner of the digital copier. Consequently we must set a different criterion for maximum visibility of the resultant image microdots. It has been observed that the range of reflection densities of most critical interest to the photographer for observing the presence of resultant image microdots in non-highlight areas are the mid-density values of about 0.8 to 1.2 (see Journal of Applied Photographic Engineering, D. M. Zwick, p. 71, vol. 8(2), April, 1982). In the shadow areas of high reflection density (low reflectance), the presence of a resultant image microdot results in only a very small decrease of reflection density and a correspondingly very small increase in brightness in a particular color record. This incremental brightness increase caused by the resultant image microdot in a dark area of the image is so low that the human visual system cannot detect the resultant image microdot.

In the embodiment of the present invention the objective is to select the hue of the resultant image microdots from the range of hues that are least readily resolvable by the human visual system when viewed against a gray background of reflection density between 0.8 and 1.2. It is understood that in any small area of the image that is colored, the apparent color of the resultant image microdots is modified by the additional absorption of the image so as to appear a different color. For example, minus-yellow resultant image microdots present in a yellow area of the image will appear (depending on the level of exposure modulation by the colorant forming the color-subtractive microdot) less yellow or white, and in a neutral gray area of the image they will appear blue under magnification.

An objective of this invention is to select the hue of the resultant image microdots from the range of hues that are least readily resolvable by the human visual system when viewed against a background of mid-range reflection densities. At the same time, the hue of the resultant image microdots useful in the practice of the invention must also be selected to conform to the sensitivities of the anticipated document scanning device to optimize detection of the resultant image microdot pattern in the document representative digital signals.

Figure 3:
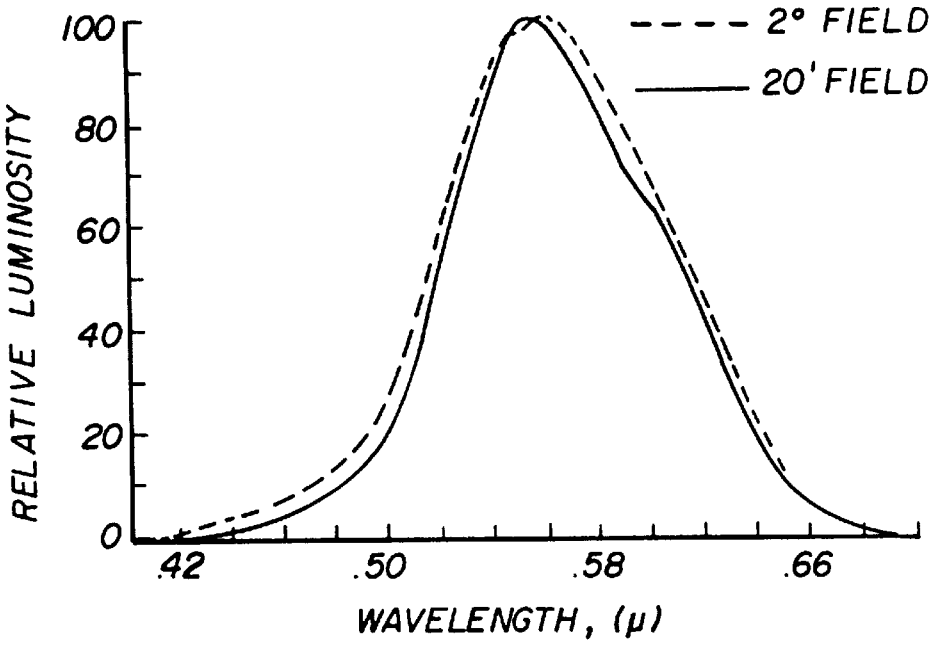
FIG. 3 is a graph illustrating the photopic luminosity functions of the human eye for two fields of centrally fixated viewing.
Figure 4:
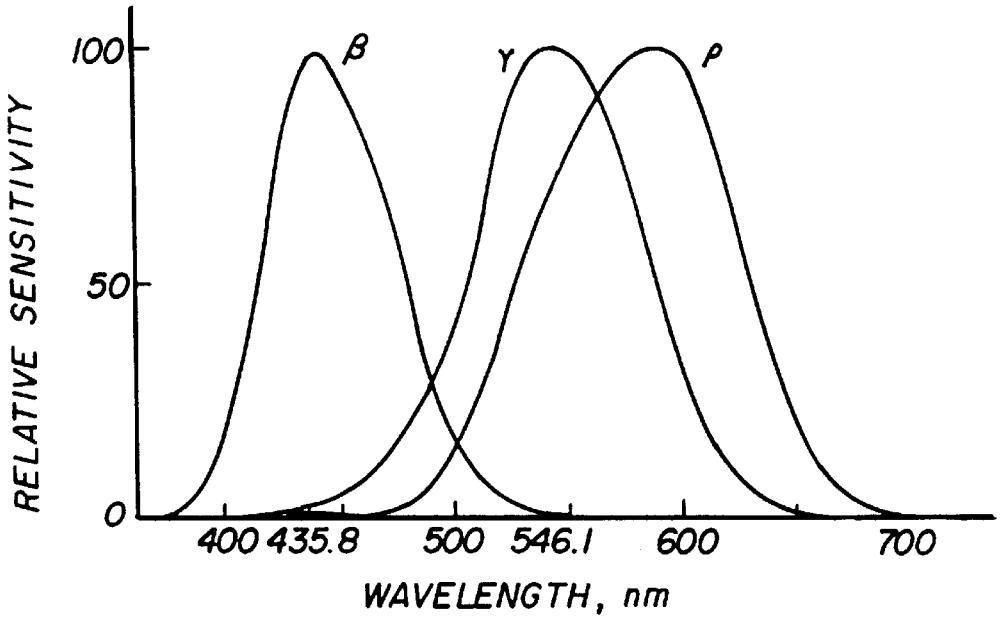
FIG. 4 is a graph illustrating trichromatic sensitivities.

FIG. 3 shows the centrally fixated luminosity response for a typical observer for two different fields of view ("NATURE," p119, vol. 156, 1945). The dashed curve is for 2 degrees and the solid curve is for 20 arcminutes field of view. The field of view for resultant image microdots of dimensions useful in the practice of this invention is approximately 0.02 degrees or 1.2 arcminutes. It is specifically contemplated that the practice of this invention will be useful in the restriction of unauthorized copying of documents on copying devices designed to produce reproductions of the original document that are visually indistinguishable from the original as seen by an observer. The sensitivity of devices of this type are typically chosen to closely approximate the sensitivities of the human visual system as shown in FIG. 4 (see "THE REPRODUCTION OF COLOUR IN PHOTOGRAPHY, PRINTING, & TELEVISION," by R. W. G. Hunt, Fountain Press, 1987, page 13).

Accordingly, the most preferred embodiment of the invention will incorporate resultant image microdots that are substantially minus-yellow or white in hue when viewed with magnification against a yellow background. Selection of minus-yellow hue will simultaneously satisfy the requirements of being least sensitive to detection by an observer, but readily detectable by a copying device. Accordingly, the most preferred method of practicing this invention is to select the hue of the resultant image microdots such that their diminished spectral reflection density (density below that of a neutral background) falls substantially in the wavelength region less than 500 nm. Substantially, as used in this disclosure, is taken to mean that at least 75% of the integrated area under a plot of spectral absorption versus wavelength between the limits of 400 nm and 700 nm falls within the specified region. The spectral absorption of light by the minus-yellow image microdots is sufficient to allow detection by the document copier, but is insufficient to render the resultant image microdots perceptible. To accommodate systems in which the opto-electronic scanning device has spectral sensitivities which depart from the normal sensitivities of the human visual sensitivities, the hue of the resultant image microdots is preferably shifted in a similar manner.

In the preferred embodiment of the invention the color-subtractive microdot pattern is added to one or more of the light-sensitive emulsion layers of the color-negative medium prior to its packaging for sale. In another embodiment of the invention the color-subtractive microdot pattern is added to a protective overcoat coated over the light-sensitive emulsion layers. Another embodiment of the invention incorporates the color-subtractive microdot pattern into the medium by coating the light-sensitive emulsion layers onto a light-reflective support containing on its surface the color-subtractive microdot pattern.

Incorporation of the color-subtractive microdot pattern onto the surface of the support of the color-negative photographic print medium prior to coating of the light-sensitive emulsion layers can be accomplished using a number of printing technologies, such as gravure printing, lithographic printing, letterpress printing, continuous or drop-on-demand inkjet printing, electrophotographic printing, or thermal printing. Printing processes are preferably operated in a web configuration, but sheet fed printing is also contemplated.

The medium of choice is passed through a printer which adds the color-subtractive microdot pattern utilizing one of the printing technologies described above. The light sensitive emulsion layers are then coated onto this medium. The user of the medium is free to record an image in the medium using any applicable information recording technology resulting in an original document which can be restricted from unauthorized reproduction according to the teachings of this invention.

In a preferred form of practicing the invention the color-subtractive microdot pattern is added to the protective overcoat and/or one or more of the light-sensitive emulsion layers of the color-negative photographic paper at the time of its manufacture and prior to its exposure to the image to be recorded in the document. One preferred method of applying the pattern of subtractive microdots to the light sensitive emulsion layers is to employ continuous or drop-on-demand inkjet printing as these are both noncontact printing technologies.

Materials useful in forming the color-subtractive microdots include all light-absorptive colorants commonly referred to as dyes, solid particle dyes, dispersions, pigments, inks, toners, etc. These colorants may be transparent or translucent (or even opaque if positioned between the support and the image-forming layers). These colorants, however, must have the added ability of being removable from the document prior to, during, or after photographic chemical processing. Water soluble dyes, such as tartrazine, are preferred colorants that will readily diffuse out of the document during chemical processing. Also preferred are colorants comprised of solid particle filter dyes that decompose during photographic chemical processing into ions or molecules that diffuse from the document. Solid particle filter dyes are discussed in Research Disclosure Number 365, September 1994, herein incorporated by reference. Also preferred are colorants that remain in the medium but are photochemically converted to a colorless form by subsequent exposure of the chemically processed print medium to ambient illumination. Colorants that are photochemically converted to a colorless form are comprised of photobleachable dyes (see pages 387–396 of "Light-Sensitive Systems: Chemistry and Application of Nonsilver Halide Photographic Processes" by Jaromir Kosar, John Wiley & Sons., New York, 1965). When the invention is practiced using a medium which is viewed by reflected light and the color-subtractive microdot pattern is incorporated prior to production of the original document, any of the colorants previously listed are useful. When the invention is practiced using a medium which has a transparent or translucent support and is viewed by transmitted light, the preferred placement of the colorant is in the protective overcoat and/or in one or more of the image recording layers. When the invention is practiced by adding the color-subtractive microdot pattern over or within the image-forming layers, the preferred forms of the colorants include those which are substantially transparent or translucent.

It is specifically anticipated that the practice of the invention is particularly useful in restricting photographic images from unauthorized copying on copying devices utilizing opto-electronic scanning devices. As described above, the color-subtractive microdot pattern can be incorporated into the light-sensitive photographic print medium prior to production of the photographic image or incorporated into a digital image prior to printing using a digital printing technology. In practicing the invention on photographic images, the color-subtractive microdot pattern can be incorporated into the photographic print medium prior to production of the photographic image, preferably during manufacture of the medium. Light reflective or transmissive photographic supports, substrates, or bases are contemplated in the practice of the invention.

It is specifically contemplated that color-negative image-forming photographic media are useful in the practice of the invention. Accordingly, photographic media contemplated in the practice of the invention will contain at least one silver halide radiation-sensitive unit sensitive to at least one portion of the spectrum extending from the ultraviolet to the infrared. It is common to have silver halide radiation-sensitive units contain more than one silver halide containing layer sensitive to the same region of the spectrum. Color recording photographic media typically contain three silver halide light-sensitive units each recording light from one of the red, green, and blue regions of the spectrum. The silver halide light-sensitive layers may or may not contain color forming precursors. The order of the silver halide containing light-sensitive layers may take on any of the forms known to one skilled in the art of silver halide media design. Technologies relevant to the design and production of photographic media can also be found in Research Disclosure Number 365.

Figure 5:
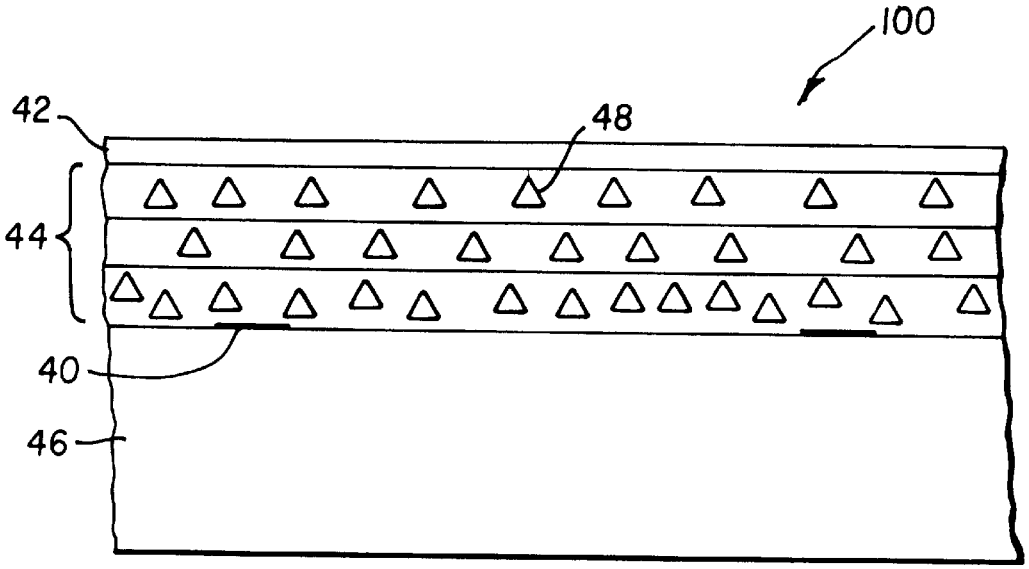
FIG. 5 is a cross-sectional representation of a light-sensitive photographic print medium containing color-subtractive microdots on the image-bearing side of the support layer.

In FIG. 5 a color-negative photographic print medium 100 consists of a light reflective support layer 46 with color-subtractive microdots 40 placed on the image-bearing side of the support layer 46 prior to the addition of one or more light-sensitive image-forming layers 44, for example, cyan, magenta, and yellow image-forming layers. Generally these image-forming layers contain unexposed silver halide grains 48 sensitive to red, green, and blue light. A protective overcoat 42 is coated over the image-forming layers 44. During subsequent exposure of the image-forming layers by the end user, the color-subtractive microdots 40, for example yellow microdots, decrease the amount of blue light exposing the silver halide grains sensitive to blue light in the yellow image-forming layer by decreasing the amount of blue light reflected by the support layer 46 back to the yellow image-forming layer. The decreased exposure of the yellow image-forming layer at the sites of the color-subtractive microdots 40 causes less yellow image dye to be formed during chemical processing of the medium at which time the color-subtractive microdots 40 are removed. The resulting decreased yellow image density produces permanent resultant image microdots that appear under magnification as minus-yellow microdots.

Figure 6:
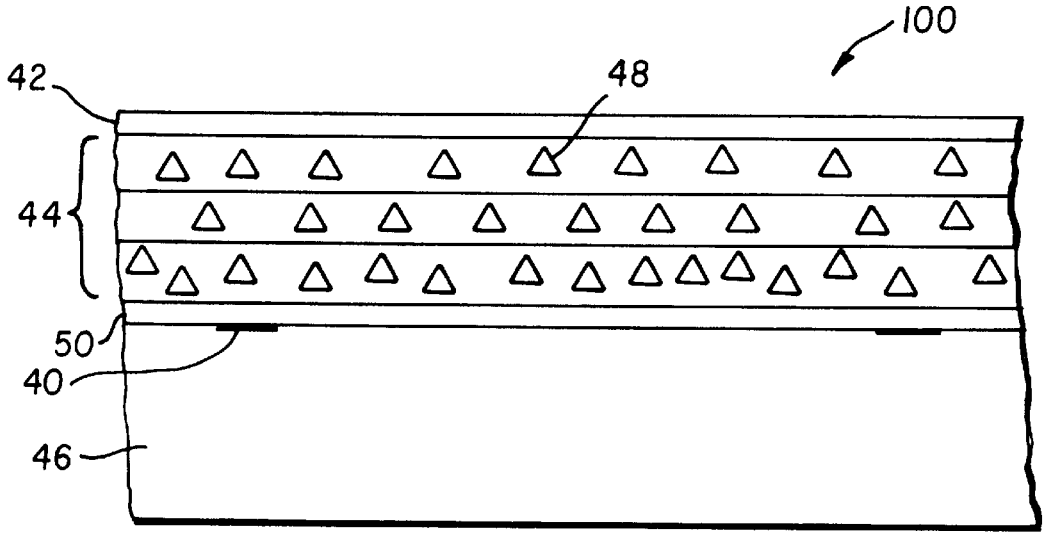
FIG. 6 is a cross-sectional representation of a light-sensitive photographic print medium containing color-subtractive microdots on the image-bearing side of the support layer with a protective layer separating the microdots from the image-forming layers.

Referring to FIG. 6, the microdots 40 are separated from the light-sensitive image-forming layers 44 by the application of a protective water permeable layer 50. It is common practice to form the thin protective layer 50 by applying a water permeable polymer such as gelatin. The preferred technique is to apply the microdot pattern to the reflective support layer 46 prior to application of the protective layer 50.

Figure 7:
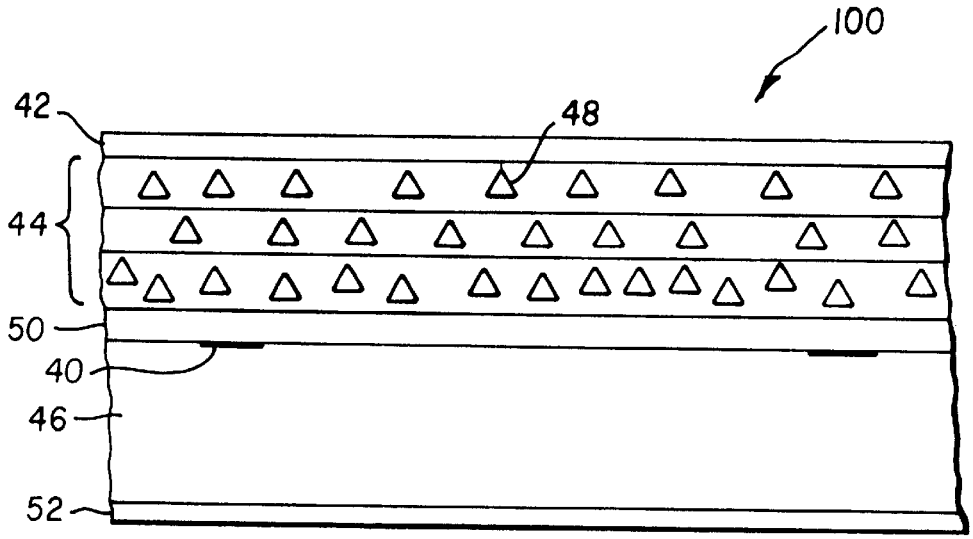
FIG. 7 is a cross-sectional representation of a light-sensitive photographic print medium containing color-subtractive microdots on the image-bearing side of the support layer with a protective layer separating the microdots from the image-forming layers and a protective layer applied to the opposite side of the support.

Next, FIG. 7 is the same as FIG. 6 except that a non-water-permeable protective layer 52 is applied to the back side of the light reflective support 46. Such a protective layer 52 is typically a polymeric resin such as polyethylene.

Figure 8:
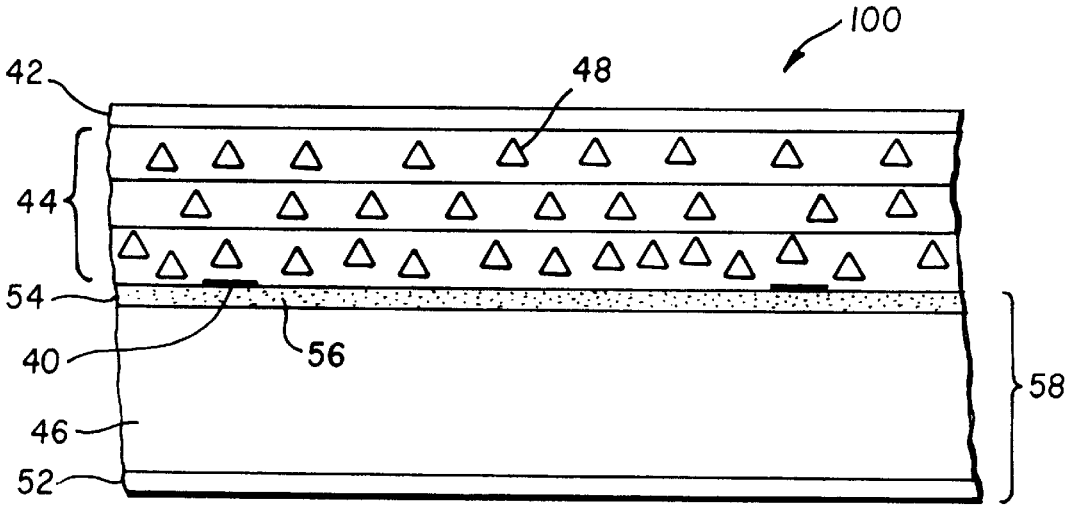
FIG. 8 is a cross-sectional representation of a light-sensitive photographic print medium containing color-subtractive microdots on the image-bearing side of a light reflective resin-coated support.

Referring to FIG. 8, in cases where a light-reflective resin coated support 58 comprised of a light-reflective layer 54 of polymeric resin is applied to the image-bearing side of the support layer 46 and containing light-scattering pigment 56 (e.g. titanium dioxide, barium sulfate, etc.) for altering the optical properties of the resin coated support 58 is employed, it is preferred to apply the microdots 40 on top of the light-reflective layer 54 after it has been applied to the reflective support layer 46.

Figure 9:
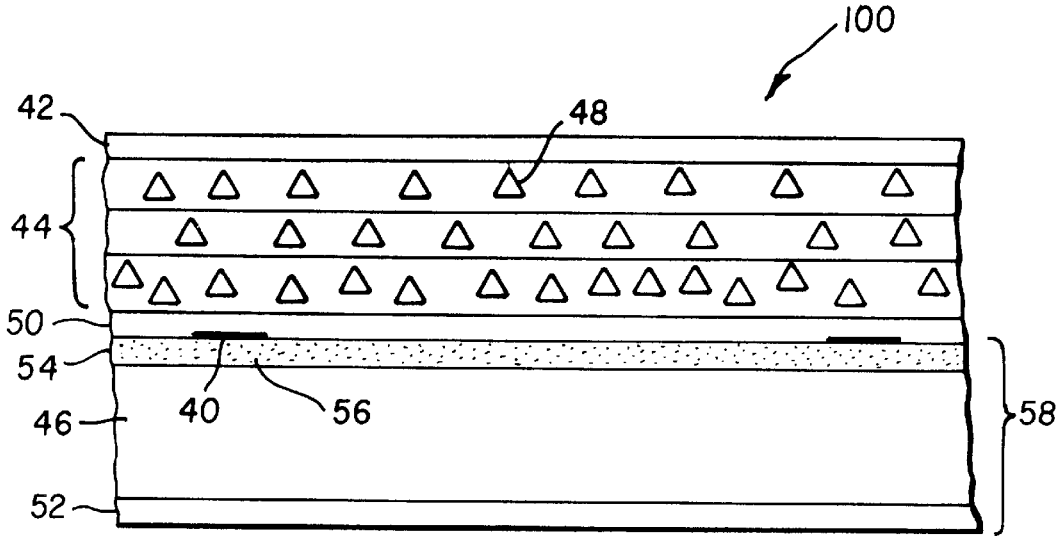
FIG. 9 is a cross-sectional representation of a light-sensitive photographic print medium containing color-subtractive microdots on the image-bearing side of a light-reflective resin-coated support with a protective layer separating the color-subtractive microdots from the image-forming layers.

FIG. 9 represents the embodiment of FIG. 8 with the addition of a water permeable protective layer 50 inserted between the microdots 40 and the light-sensitive image-forming layers 44.

Figure 10:
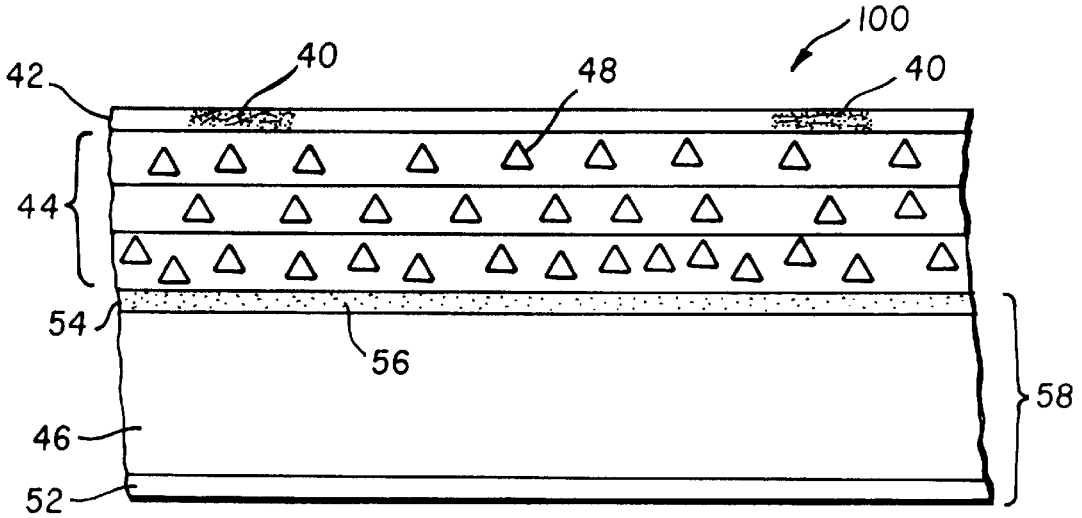
FIG. 10 is a cross-sectional representation of a light-sensitive photographic print medium containing color-subtractive microdots of colorant diffused into a protective overcoat.

Referring to FIG. 10, a light-reflective layer 54 comprised of polymeric resin containing light-scattering pigment 56 is applied to the image-bearing side of the light reflective support layer 46. A polymeric resin layer 52 is applied the back side of support 46. The image-forming layers 44 are coated above the light-reflective layer 54. After application of the image-forming layers 44 and before winding of the color-negative photographic print medium 100, color-subtractive microdots 40 are applied to the protective overcoat 42, typically by continuous inkjet printing of a water soluble dye. As shown in the figure, the water soluble dye diffuses into the protective overcoat 42 to provide a color-subtractive microdot. For example, a yellow, water soluble dye applied by inkjet printing would diffuse into the protective overcoat 42 and absorb blue light when the color-negative photographic print medium 100 is subsequently exposed by the end user. The yellow, water soluble dye diffuses out of the protective overcoat 42 during subsequent chemical processing to render the latent image recorded by the silver halide grains in the image-forming layers 44 visible as a color image. An alternative method of removal of colorant forming the microdots 40 is the use of pH sensitive indicator dyes that become non-absorbing at the final pH of the chemically processed image. Another method of colorant removal is the use of a photobleachable dye to form the microdot which subsequently bleaches to a non-absorbing form when the chemically processed print is exposed to ambient illumination during viewing. In those locations where the yellow subtractive microdot is present, the formation of yellow image dye during image-wise exposure by the end user is reduced as a result of the reduced exposure of the yellow image-forming layer to blue light.

Figure 11:
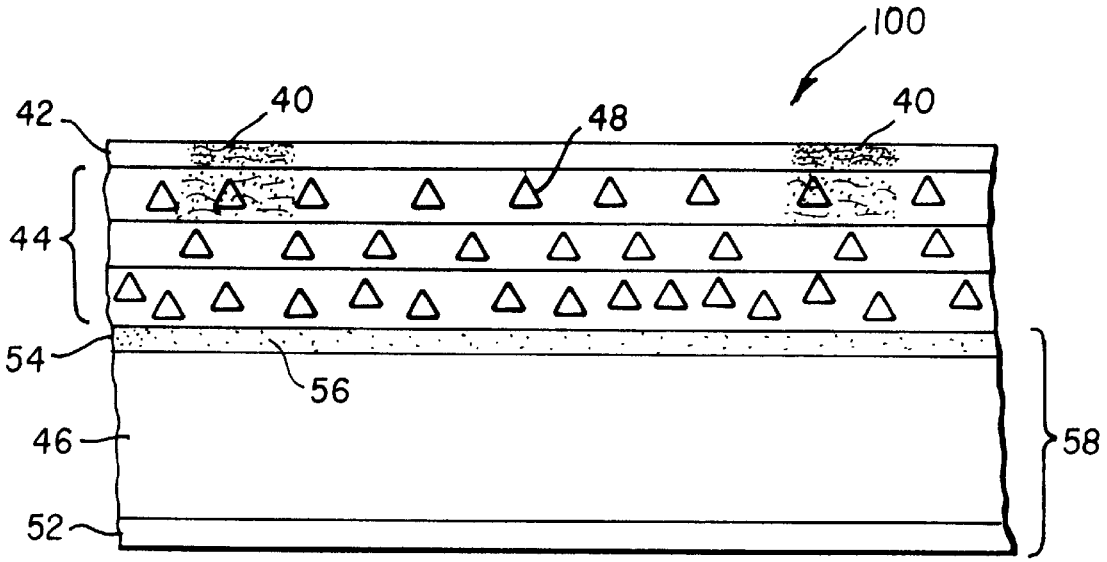
FIG. 11 is a cross-sectional representation of a light-sensitive photographic print medium containing color-subtractive microdots of colorant diffused partially into a protective overcoat and partially in the uppermost image-forming layer.
Figure 12:
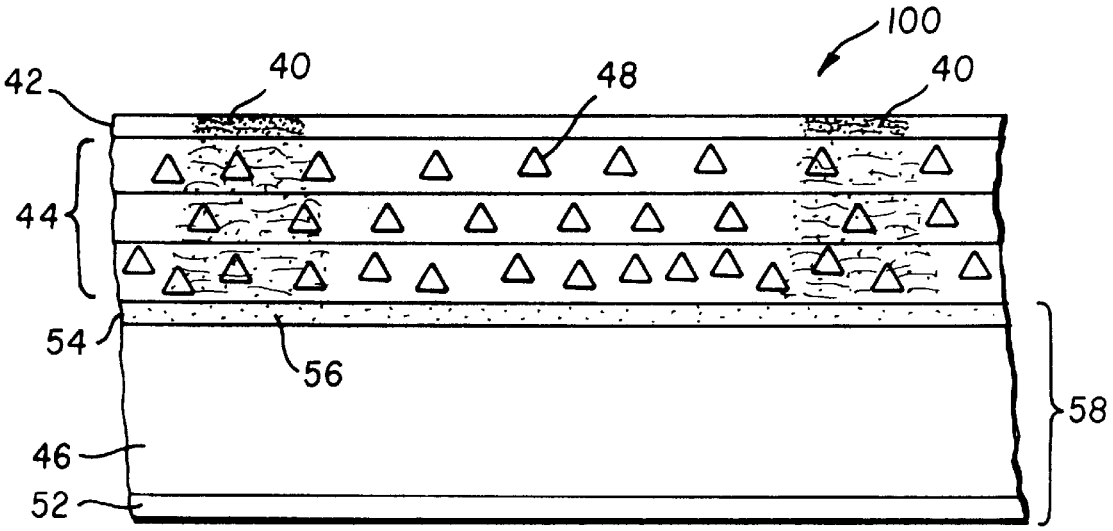
FIG. 12 is a cross-sectional representation of a light-sensitive photographic print medium containing color-subtractive microdots of colorant partially diffused into a protective overcoat and all image-forming layers.

FIG. 11 is similar to FIG. 10 except that the water soluble dye in the color-subtractive microdot 40 has diffused further into the medium to reside in both the overcoat 42 and the uppermost of the light-sensitive image-forming layers 44. In FIG. 12 the water soluble dye in the color-subtractive microdot 40 has diffused into the protective overcoat 42 and all three of the light-sensitive image-forming layers 44. Regardless of the depth-wise distribution of the colorant, it is able to decrease the exposure of predominately one of the image-forming layers sufficiently to produce the requisite signal of copy-restriction in the exposed and processed color-negative photographic print medium.

Figure 13:
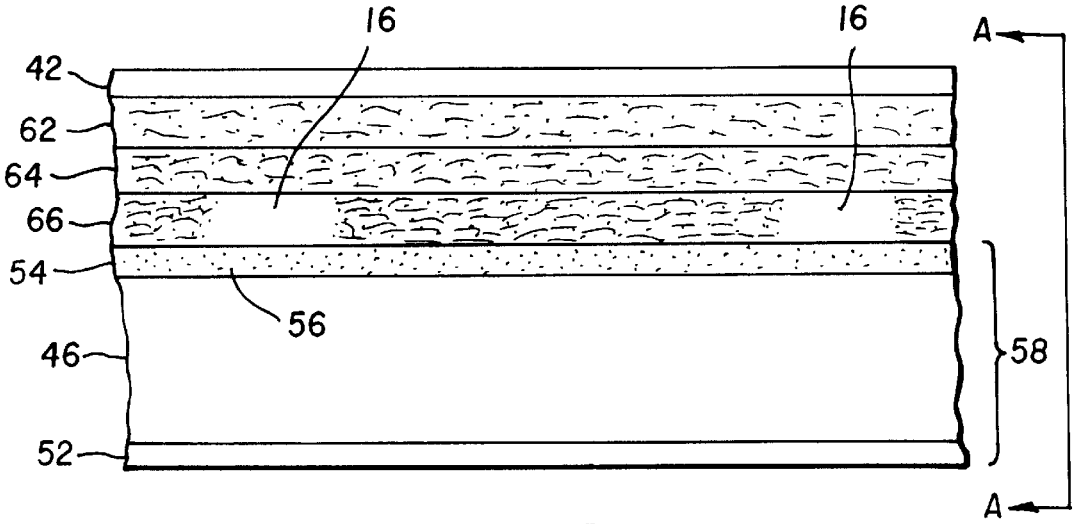
FIG. 13 is a cut-away sectioned view taken along the section lines A—A of the embodiment of FIG. 1.

FIG. 13 shows a cross-sectional view A—A of the original document 10 created from the photographic print medium 100 after exposure to an image by the end user and after chemical processing has converted the latent image in the silver halide grains to a full color image 12 recorded in three primary color records 62, 64, and 66, for example, cyan, magenta, and yellow, respectively. The permanent microdots 16 are recorded in the image as a reduction of image dye in primarily one of the three primary color records, preferably the yellow color record 66.

Colorants useful in the practice of the invention include, but are not limited to, water soluble dyes and filter dyes incorporated in photographic media as described in Research Disclosure Number 365, September 1994. Colorants requiring a binder for attachment to the support are contemplated to be incorporated into any convenient water permeable binder or carrier useful as a carrier or binder for light-sensitive silver halide grains. Continuous or drop-on-demand inkjet deposition of water soluble dyes directly to the light-sensitive emulsion layers requires only water as the carrier. The preferred colorants are chosen from those which are difficult to perceive and not photographically active so as to not desensitize the silver halide grains 48.

The exposed and processed copy restrictive document containing the permanent resultant image microdot pattern, is scanned with an opto-electronic scanning device generally associated with the copy print station of FIG. 2. A copy restrictive document detecting system utilizes a scanner 22 and digital image processing unit 24 to detect the presence of the resultant image microdot pattern. The detecting unit controls the operation of a copying device or printer 30 which does not rely on opto-electronic scanning techniques to produce a reproduction of the original document. A digital copying system, incorporating an opto-electronic scanning device, utilizes a sub-sampled set of data obtained from the scanning of the copy restrictive document for the purpose of controlling document reproduction. A digital copying system utilizing an opto-electronic scanning device may be used to pre-scan the copy restrictive document for the purpose of previewing and detecting the presence of the resultant image microdot pattern. If an resultant image microdot pattern is not detected, a second scan of higher resolution is performed for the purpose of controlling document reproduction. The design of the opto-electronic scanning device is selected from any of the designs known to those skilled in the art of scanner design. A preferred scanning device utilizes a separate opto-electronic sensor and or illumination source conforming to the spectral properties of the resultant image microdot pattern.

The resolution of the opto-electronic scanning device used to detect the presence of the resultant image microdot pattern in the original document is chosen to distinguish the resultant image microdots from the surrounding document area. A preferred scanning resolution is equal to or greater than 75 dots per inch (dpi) and is typically 200 dpi.

Scanning a document with the opto-electronic scanning device produces electronic signals corresponding to the pixel-by-pixel optical absorptance of the document. The electronic signals representative of the original document may be converted into a corresponding set of density representative electronic signals. The electronic signals, representative of the document, are preferably converted into a digital image prior to subsequent electronic processing to detect the presence of a resultant image microdot pattern in the document.

The presence of resultant image microdots can be ascertained by an examination of the digital image in a variety of ways. The number of resultant image microdots in the image may be counted by determining the number of regions of the digital image with code values and of a size and shape that are indicative of a resultant image microdot. Alternatively, the presence of the spatial pattern of the resultant image microdots, in the digital image, may be detected by means of image processing such as described in "DIGITAL IMAGE PROCESSING," 2nd Edition, William K. Pratt, Sun Microsystems, Inc., Mountain View, Calif., John Wiley and Sons (1991).

Prior to analysis of the digital representation of the original document for the purpose of detecting the presence of the resultant image microdot pattern, transformation of the digital signals into other metrics is preferred. One such transformation that is anticipated is to convert R, G, and B density representative signals into corresponding L* a* b* representative signals (see "The Reproduction of Colour in Photography, Printing, and Television," by R. W. G. Hunt, Fountain Press, 1987). Other color space transformations are also anticipated as being useful in the practice of this invention.

Detection of resultant image microdots in the digital representation of the document is conducted throughout the entire image. In an alternative and preferred method of practicing the invention, the entire image can be segmented into sub-sections. The average color of each sub-section can be determined and those sections having average colors which favor the detection of resultant image microdots can be preferentially evaluated. Sub-sections which are substantially blue or of high lightness are recognized as being preferred for the detection of resultant image microdots.

The apparent color of a resultant image microdot in the image can be affected by the colors of the image surrounding the resultant image microdot and by the optical characteristics of the scanning device. To facilitate detection of resultant image microdots in the digital representation of the document, it is anticipated and preferred to adjust the color expectation when searching for a resultant image microdot based on the average color of the area of the document being evaluated. The color expectation for a resultant image microdot in any medium as seen by any opto-electronic scanning device can usually be determined empirically.

A Fourier transform of the section or sub-section of the digital representation of the original document is performed after determination of those pixels which represent resultant image microdots. The two-dimensional frequency spectrum obtained can then be evaluated at those frequencies anticipated for periodic patterns.

Direct optical detection of resultant image microdots can take the form of the measurement of the optical reflection or transmission of light by the document with a spatial resolution sufficient to resolve a resultant image microdot. Another method of direct optical detection of resultant image microdots is by the use of an optical correlator. Optical correlators are discussed in, "INTRODUCTION TO FOURIER OPTICS," by J. W. Goodman, McGraw-Hill, 1968.

The copying process is allowed to continue unimpeded if the presence of the resultant image microdot pattern is not detected in a document. If the resultant image microdot pattern indicative of a copy restrictive document is detected, a signal indicating the detection of a copy restrictive document is turned on and the copying process is halted by the controlling software of the copying device. After detection of the resultant image microdot pattern, the copying process may be re-initialized for the next document. Optionally, the copying system may be disabled until an authorized operator intervenes. The authorized operator may re-enable the copying process if authorization to copy is provided, or the copying device is re-initialized without producing a copy if no authorization is available.

EXAMPLE

This is an example of employing inkjet printing technology to apply yellow subtractive microdots to color-negative photographic paper prior to its exposure to an image.

Microsoft Excel™ Version 4.0 spreadsheet software loaded onto a Macintosh II™ personal computer (PC) was used to prepare a digital file of microdots. When this file was sent to a Hewlett Packard DeskWriter 550C™ thermal drop-on-demand inkjet printer linked to the PC, a document was created with the Hewlett Packard black inkjet cartridge printing black microdots in a square array of 72 horizontal by 96 vertical on standard 8.5"×11" Hammermill white copy paper. The size of the microdots averaged about 0.10 mm in diameter with a spacing in both directions of about 2.5 mm. The size of the microdots was controlled through the software by specifying a Geneva font style with a minimal font size of 1. Next, the black Hewlett Packard inkjet cartridge was replaced with an Encad Novajet™ cartridge (PN 201810) containing Encad's yellow dye in water and the microdots were again printed to Hammermill white copy paper. The yellow microdots again printed to a size of about 0.10 mm with the same spacing. Next, the yellow microdots were printed to an 8"×10" sheet of Eastman Kodak Professional Portra III™ (E surface) photographic paper under roomlight conditions. The sheet was fastened to the Hammermill paper at one edge with adhesive tape to facilitate transport through the printer when the yellow microdots were inkjet printed. The presence and printing quality of the yellow microdots was verified with a 10X loop. The sheet was then placed in Eastman Kodak F-5™ for 3 minutes. The print was washed for 3 minutes, dried, and then examined. This step allowed removal of the light-scattering silver halide grains and absorber dyes from the emulsion layers. The print was totally white with no yellow microdots or yellow stain anywhere on its surface, so the yellow dye of the color-subtractive microdots was totally removed in the aqueous fixer solution. Finally, the room lights were turned off and infrared binoculars were worn while mounting another sheet of Portra III™ paper to a sheet of Hammermill paper. The inkjet printing of the yellow microdots progressed under darkness with the monitor of the PC covered with black cloth. When the printing was complete the photographic paper was placed in a light-tight box. Several more sheets were identically inkjet printed and stored.

A Berkey Omega D5500™ color enlarger with a Chromega D Dichroic II™ head was used with a Schneider-Kreuznack Componon-S™ f/5.6 135 mm focal length lens stopped down to f/16 to enlarge a 4"×5" color negative to fill the 8"×10". The dichroic settings were 00 cyan, 40 magenta, and 58 yellow when printing a 4"×5" color negative containing a Portrait Scene enlarged to fill 8"×10" Eastman Kodak Portra III™ color-negative paper with E surface. The paper was photographically processed using a Colenta Color Paper Processor™.

Figure 14:
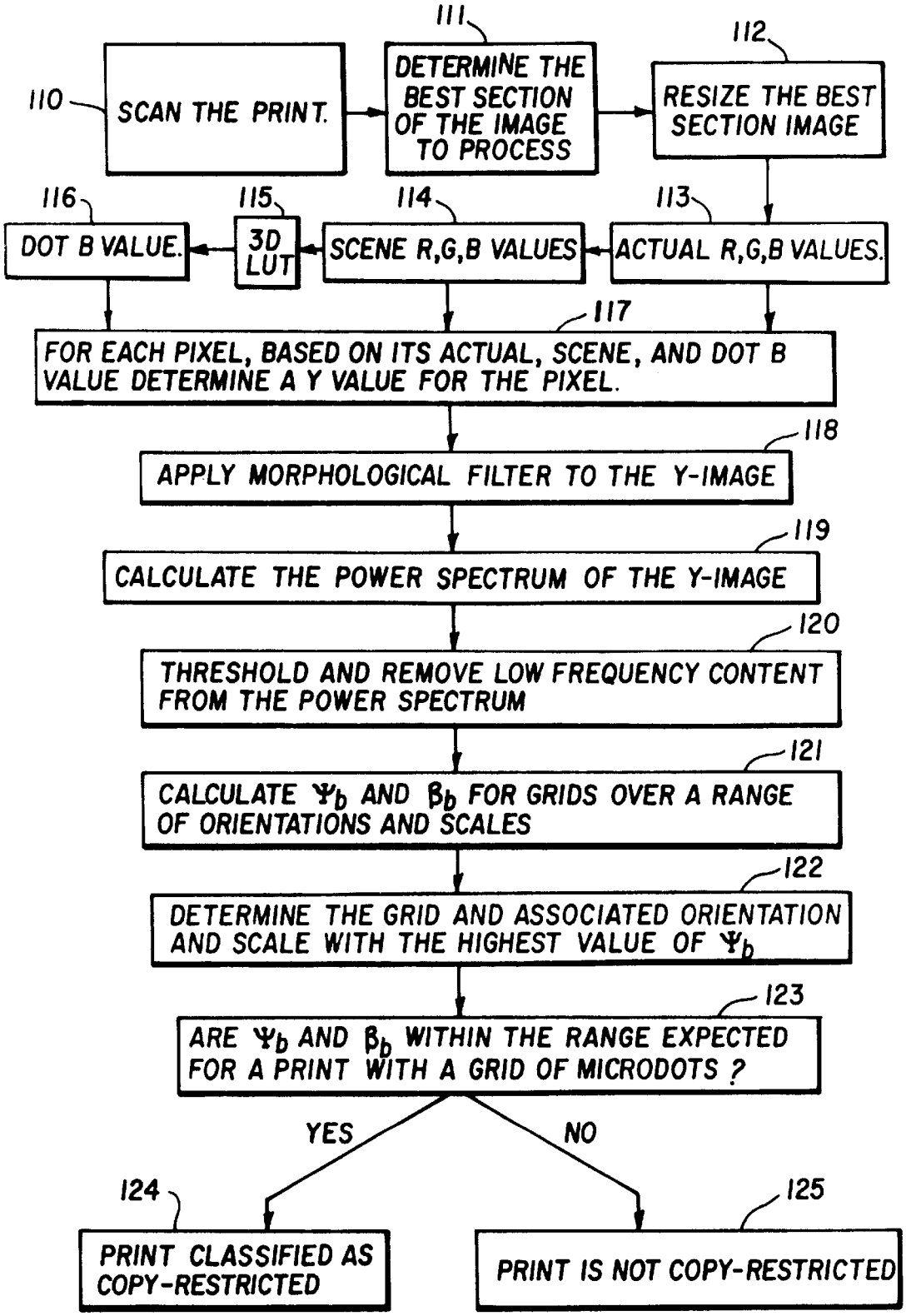
FIG. 14 is a flowchart of one form of microdot detection algorithm.

Referring to FIG. 14 we describe the steps that are required to automatically detect the microdots in the photographic print of the Portrait Scene. First, the print is scanned, step 110, by an Epson™ ES800C flat bed scanner at a resolution of 200 dpi. In the next step 111, the 256×256 pixel section of the digital image with mean blue code value closest to 100 (from a range of 0 to 255) was chosen for further processing. This criteria was used because the minus-yellow microdots are most detectable in the midtone range of the blue band. If the image had been scanned at a higher resolution than 200 dpi, for instance, at 400 dpi in step 111, a 512×512 pixel section would have been chosen and in step 112 the section would have been resized to 256×256. This is done so that the processing speed of subsequent steps are independent of the resolution at which the print is scanned.

For each pixel in the 256×256 pixel sub-image we calculate a quantity Y (step 117) which is given by $$Y=255[1-|b_a-b_d|/|b_s-b_d|]\ |b_s-b_d|\geqq C$$

$$Y=0\ |b_s-b_d|<C \qquad \text{Equation (1)}$$

where $b_a$ is the blue code value of the pixel in step 113, $b_s$ is the blue code value of the pixel after a 5×5 median filter has been applied in step 114, and in step 116 $b_d$ is the blue code value of a pixel that contains a minus-yellow microdot. The value of $b_d$ is dependent on the background color at which the microdot occurs. By scanning the colorpatch print described previously, a 3D look-up-table (LUT) 115 was made that gives the value of $b_d$ for any background color. In order to obtain $b_d$ while processing an image a 5×5 median filter is used to estimate the red, green, and blue background code values. These values are used as input to the 3D look-up-table in step 115 to obtain $b_d$. Finally, the value of C in Equation (1) is seven.

Figure 15:
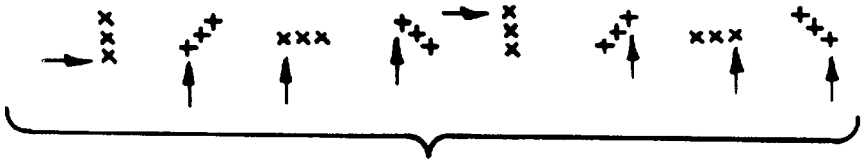
FIG. 15 is a drawing of eight morphological filters.

The result of step 117 is a 256×256 pixel image, which we refer to as the Y-image that retains the image of the minus-yellow microdots, but removes the content of the scene that is printed on the paper. Because some image content still remains in the Y-image, we apply in step 118 a morphological filter to the image that attenuates all structures in the image other than single pixel dots. This is accomplished with the series of eight morphological filters shown in FIG. 15 where the arrow denotes the origin of the filter. (See *Image Analysis and Mathematical Morphology Volume* 1, by Serra, Academic Press, 1982, pages 424–445.) Each operator is placed so that the origin is located at pixel p and line l of the Y-image and the minimum code value is found according to the equation $$V_i(p,l)=Min(Y(p',l'))\ p',l'\epsilon O_i \qquad \text{Equation (2)}$$

where $O_i$ is the i'th filter. Next, the maximum value of all the $V_i$, $V_{max}$, is calculated.

$$V_{max}(p,l)=Max(V_i(p,l)) \qquad \text{Equation (3)}$$

Finally, the filtered Y-image is set equal to the difference between the Y-image and $V_{max}$ $$Y_{filtered}(p,l)=Y(p,l)-V_{max}(p,l) \qquad \text{Equation (4)}$$

In the next step 119, the discrete Fourier transform of the Y-image is calculated with a fast Fourier transform algorithm (see Press, et al., *Numerical Recipes in C, Second Edition*, Cambridge University Press, 1992, pages 525–531). The square of the magnitude of the Fourier transform for frequencies between the Nyquist frequencies are stored in a two-dimensional array of real numbers. This array is referred to as the power-spectrum.

The power-spectrum usually consists of an array of peaks arising from the grid of minus-yellow microdots if it is present, periodic scene content that was passed into the Y-image, and perhaps periodic texture of the paper. In addition to this there may be low amplitude contributions to the power-spectrum due to non-periodic scene content and paper texture that also contributes to the Y-image. Before we go to the next step of determining whether peaks in the power-spectrum are indicative of the grid of minus-yellow microdots, we attempt to remove this low-level power and set to zero the region of the power-spectrum that cannot contain contributions from the microdots (step 120).

Low amplitude power is removed from the power-spectrum by thresholding it according to the following equation $$\text{if } \{\|H(f_x f_y)\|^2<T_{min}\}\ H(f_x f_y)=0 \qquad \text{Equation (5)}$$

where $T_{min}$ is set to 0.06.

All power is removed from the power-spectrum at frequencies that are too low to contain a contribution from the microdots. This is explicitly stated as follows:

$$\text{if } \{f_x \& f_y \leq f_{cutout}\}\ H(f_x f_y)=0 \qquad \text{Equation (6)}$$

where $f_{cutout}$ equals 5.0.

At this point in the processing chain we have a power-spectrum in which some frequencies may have power concentrated in them. The problem now is to determine if these peaks, if they exist, are the signature of the microdots in the frequency domain for a range of orientation and microdot spacing. The method used to detect this grid is related to the Hough transform (Pratt, *Digital Image Processing, Second Edition*, John Wiley and Sons, New York, 1991, pages 613–614) which is used to detect lines in an image. The Hough transform may be generalized as a method of accumulating evidence for the existence of a parametrized curve in an image by calculating within limits all possible values of the parameters for each pixel in the image with a sufficiently high code value (Nieman, *Pattern Analysis and Understanding, Second Edition*, Springer-Verlag, Berlin, 1990, p. 188).

Figure 16:
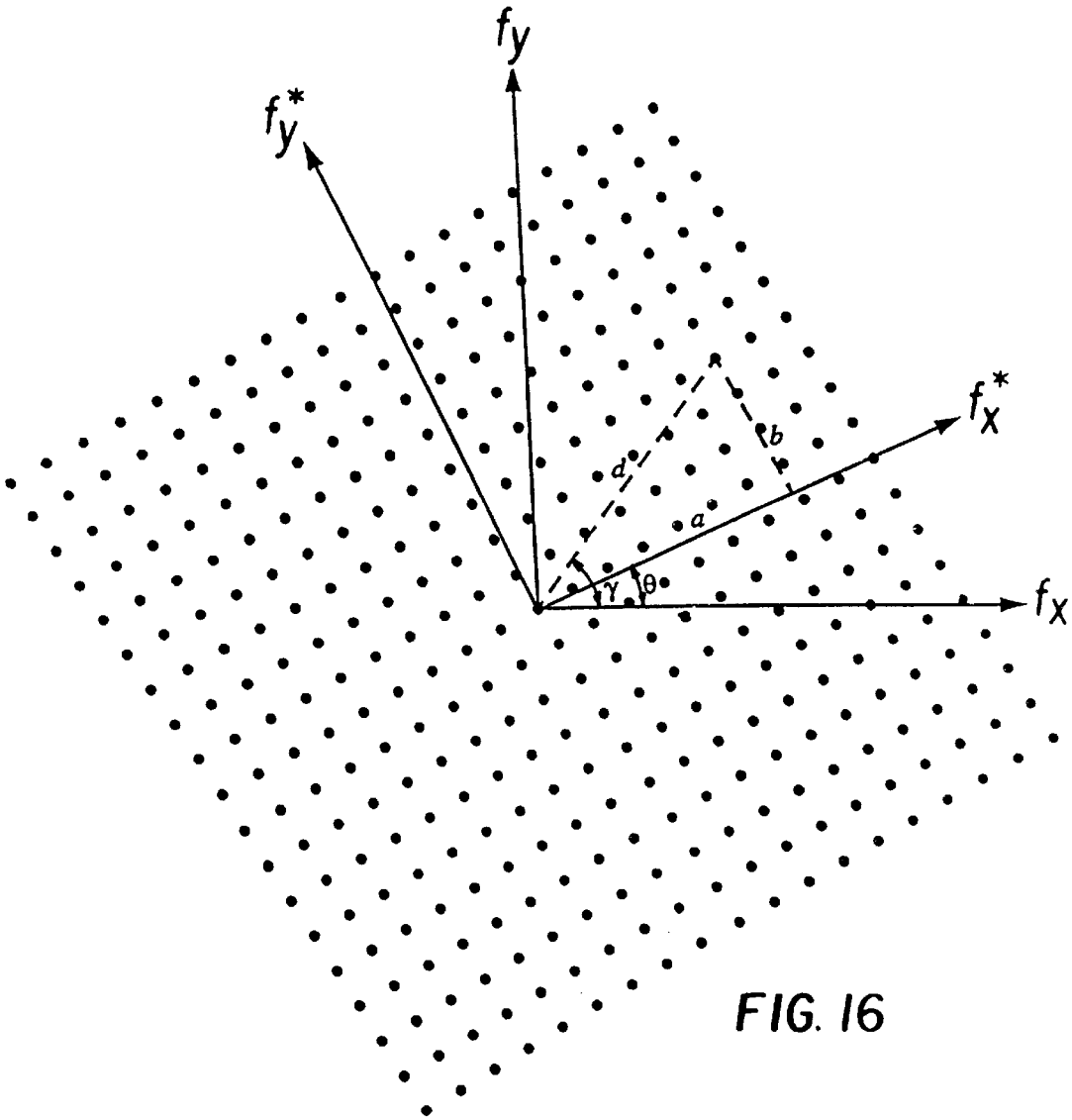
FIG. 16 represents an array of discrete spatial frequencies in the Fourier transform.

To implement steps 121 and 122 it was necessary to design a transform which accumulates evidence for a rectangular grid with scale and orientation as parameters. FIG. 16 shows a grid in frequency space where each dot represents a frequency in the discrete Fourier transform. The coordinate system with axes labeled $f_x$ and $f_y$ correspond to the horizontal and vertical directions of the digital image, respectively. The coordinate system with axes labeled $f_x$* and $f_x$* is rotated counter-clockwise by an angle θ. We refer to this coordinate system as the * coordinate system.

Consider a line between the origin and a point in the frequency space at position ($f_x$, $f_y$). The length of the line, d, is given by $$d = \{f_x^2 + f_y^2\}^{1/2} \qquad \text{Equation (7)}$$

The line is at an angle, γ, with respect to the $f_x$ axis given by $$\gamma=a\cos(f_x/d) \qquad \text{Equation (8)}$$

We now calculate the projection of the line onto the $f_x$* and $f_y$* axes. Consider a set of angles $$\theta_i=i\Delta\theta+\theta_{min}$$

$$0\leq i=(\theta_{max}-\theta_{min})/\Delta\theta \qquad \text{Equation (9)}$$

where i is an integer and Δθ is the resolution with which the θ is to be determined. The projection onto the $f_x$* axis is $$a=d\cos(\gamma-\theta_i) \qquad \text{Equation (10)}$$

and onto the $f_y$* axis is $$b=d\sin(\gamma-\theta_i) \qquad \text{Equation (11)}$$

The grid in the spatial domain is assumed to be rectangular with a nominal horizontal period $p_x$ and vertical period $p_y$. The value of $p_x$ and $p_y$ may vary independently in proportion to the scale factors $Sx_j$ and $Sy_j$, respectively. These scale factors are given by $$S_{xj}=j\Delta S+S_{min}$$

$$S_{yk}=k\Delta S+S_{min}$$

$$0\leqq j,k\leqq(S_{max}-S_{min})/\Delta S \qquad \text{Equation (12)}$$

where j and k are integers and ΔS is the resolution with which the scale is to be determined.

For all combinations of values of the two scale factors a fundamental frequency is calculated as follows $$f_{x0}=N/(S_{xjPx})$$

$$f_{y0}=M/(S_{ykPy}) \qquad \text{Equation (13)}$$

The points in the grid in frequency space represent harmonics of the fundamental frequency of the grid. For any point ($f_x$, $f_y$) in frequency space we ask the question: If the point belongs to a grid that is aligned with the * coordinate system, what harmonic does it belong to? If the point is indeed a harmonic, then the best guess of its order $m_x$ and $m_y$ are $$m_x=N\ int(a/f_{x0})$$

$$m_y=N\ int(b/f_{y0}) \qquad \text{Equation (14)}$$

The differences between the projections of a point onto the axes of the * coordinate system and the projection of a point in the frequency space grid that exactly corresponds to the frequency of order ($m_x$, $m_y$) are $$\Delta_x=\|f_{x0}m_x-a\|$$

$$\Delta_y=\|f_{x0}m_x-b\| \qquad \text{Equation (15)}$$

We conclude that the point actually belongs to a grid if $$\Delta_x\leqq Q \text{ and } \Delta_y\leqq Q \qquad \text{Equation (16)}$$

where Q is a constant. In practice, Q is set to 0.75 to allow for sampling error.

When a point in frequency space is classified in step 121 as belonging to a grid with orientation $\theta_i$ and scales $Sx_j$ and $Sy_j$, the power at that frequency is added to a matrix which accumulates evidence of the existence of a grid at orientation angle $\theta_i$ and scales $Sx_j$ and $Sy_j$ as follows $$E(\theta_i, S_{xj}, S_{yk}) = E(\theta_j, S_{xj}, S_{yk}) + \frac{\|H(f_x, f_y)\|^2}{P_{total}} \qquad \text{Equation (17)}$$

where $\|H(f_x,f_y)\|^2$ is the power at frequency $f_x$, and $f_y$ and $P_{total}$ is the total power in the discrete Fourier transform within the frequency range of interest. Due to symmetry we need only consider one-half of the frequency plane. Also, we do not include frequencies with a DC component because the power at these frequencies is largely due to boundary effects. We exclude the frequency axes ($f_x$ or $f_y$=0) because those frequencies contain power simply due to the non-periodic nature of the Y-image. Finally, since the Fourier transform of a set of real numbers has inversion symmetry about the origin it is only necessary to include frequencies with positive values of $f_y$.

Because of the thresholding and cut-out of the power-spectrum, as described above, only frequencies with a high amount of power in them will contribute to E. The number of frequencies that contribute to E for indices i, j, and k is a very important quantity and is denoted by $\beta_{ijk}$.

It is prudent to place a limit on the amount of power that a single frequency may contribute to E in order to avoid false positives. The value of $\|H(f_x,f_y)\|$ in Equation (17) is limited according to $$\|H(f_x,f_y)\|=Min(\|H(f_x,f_y)\|,H_{max}) \qquad \text{Equation (18)}$$

The final metric is based on the maximum value of E that was determined over the range of orientation and scales for which E was calculated. This metric is given by $$\Psi = \frac{100E(\theta_i, S_{xj}, S_{yk})_{\max}}{K} \qquad \text{Equation (19)}$$

where K is 0.73. When the Y-image used in the calculation of Ψ is as computed using Equation (1) we denote the metric by $\Psi_b$. We next determine in step 122 the value of $\beta_{ijk}$ simply denoted by β, corresponding to the orientation and scales at which the maximum value of $\Psi_b$ occurs.

The number of frequencies that contributed to $\Psi_b$ we denote by $\beta_b$. The metric $\beta_b$ is used to ensure that a high value of $\Psi_b$ is the result of a grid of frequencies with high power that have a separation characteristic of the grid of minus-yellow microdots.

Referring back to FIG. 14, in step 123, for a print to be classified as copy-restricted, $\Psi_b$ must equal or exceed a threshold $\Psi_{thres}$ as indicated by the following equation:

$$\Psi_b\geqq\Psi_{thres}=20 \qquad \text{Equation (20)}$$

Simultaneously, the number of frequencies that contributed to the metric must be in the range given by:

$$\beta_{min}=50\leqq\beta_b\leqq250=\beta_{max} \qquad \text{Equation (21)}$$

This condition ensures that the periodic feature of the print which is contributing to $\Psi_b$ is of the proper frequency.

The threshold for Ψ and the permitted range of $\beta_b$ are chosen so that prints with the microdots will be classified as copy-restricted in step 124 and prints without the microdots are classified as not copy-restricted in step 125.

The values chosen for the various parameters described above are:

$$M = 256 \quad N = 256$$

$$L = 2 \quad C = 7.0$$

$$p_x = 25.1 \quad p_y = 25.1$$

$$S_{\min} = 0.98 \quad S_{\max} = 1.02 \quad \Delta S = 0.005$$

$$\theta_{\min} = 0.00° \quad \theta_{\max} = 90.0° \quad \Delta\theta = 0.50°$$

$$Q = 0.75 \quad K = 0.73$$

$$T_{\min} = 0.06 \quad f_{cutout} = 5 \quad H_{\max} = 0.76$$

$$\Psi_{thres} = 20.0 \quad \beta_{\min} = 50 \quad \beta_{\max} = 250$$

The print of the Portrait Scene described previously with minus-yellow resultant image microdots was scanned (step 110) and then the digital image was processed starting at step 111 and proceeding to step 113. The value of $\Psi_b$ was 111 and the value of β was 57. For the "check" print of the Portrait Scene that did not contain minus-yellow resultant image microdots, the value $\Psi_b$ was 137 and the value β was only 1. Therefore, according to Equations (20) and (21) the "experimental" print with minus-yellow resultant image microdots was correctly classified as copy-restricted and the print without microdots was correctly classified as not being copy-restricted.

Four experienced photographers were asked to examine the two color-negative photographic prints containing the Portrait Scene without any visible identification of their content. The photographers were asked to judge if there was anything visibly different or objectionable about either or both prints. No limitation was placed on viewing distance and the ceiling lighting was fluorescent using a bank of Sylvania Cool White Deluxe 40 Watt lamps that provided a bright viewing condition typical of a viewing booth used by professional photographers. All four judges rated the prints of equal quality with no visible difference between them.

The invention has been described with reference to preferred embodiments. However, it will be appreciated that variations and modifications can be effected by a person of ordinary skill in the art without departing from the scope of the invention.

PARTS LIST

| | |
|---|---|
| 10 | original document |
| 12 | image |
| 14 | window |
| 16 | resultant image microdot |
| 20 | copy print station |
| 22 | scanner |
| 24 | digital image processing unit |
| 26 | keyboard |
| 28 | monitor |
| 30 | printer |
| 40 | color-subtractive microdot |
| 42 | protective overcoat |
| 44 | light-sensitive image-forming layers |
| 46 | light-reflective support layer |
| 48 | silver halide grains |
| 50 | protective layer |
| 52 | protective layer |
| 54 | light reflective layer |
| 56 | light-scattering pigment |
| 58 | light-reflective resin coated support |
| 62 | primary color record |
| 64 | primary color record |
| 66 | primary color record |
| 100 | color-negative photographic print medium |
| 110 | step, scan the print |
| 111 | step, determine the best section of the image to process |
| 112 | step, resize the best section image |
| 113 | step, actual r,g,b values |
| 114 | step, scene r,g,b values |
| 115 | step, 3D LUT |
| 116 | step, Dot b value |
| 117 | step, determine a Y value for the pixel |
| 118 | step, apply morphological filter to the Y-image |
| 119 | step, calculate the power spectrum of the Y-image |
| 120 | step, threshold and remove low frequency content from the power spectrurn |
| 121 | step, calculate $\Psi_b$ and $\beta_b$ for grids over a range of orientations and scales |
| 122 | step, determine the grid and associated orientation and scale with the highest value of $\Psi_b$ |
| 123 | question, are $\Psi_b$ and $\beta_b$ within the range expected for a print with a grid of blue dots? |
| 124 | step, print classified as copy-restricted |
| 125 | step, print is not copy-restricted |

What is claimed is:

1. A copy restrictive color-negative photographic print medium comprising:

a support layer;

at least one image-forming layer supported by said support layer;

a clear protective overcoat above said at least one image-forming layer; and a pattern of removable color-subtractive microdots, positioned between said support layer and said at least one image-forming layer, for causing the formation of resultant image microdots in a processed image;

wherein said resultant image microdots are substantially undetectable by casual observation under normal viewing conditions of said processed image.

2. The copy restrictive color-negative photographic print medium according to claim 1 and further comprising:

a protective layer of transparent material positioned over said pattern of removable color-subtractive microdots and beneath said at least one image-forming layer.

3. The color-negative copy-restrictive photographic print medium according to claim 1 wherein said support layer is a reflective support.

4. The color-negative copy-restrictive photographic print medium according to claim 1 and further comprising a light-reflective layer positioned between said support layer and said pattern of removable color-subtractive microdots.

5. The copy restrictive color-negative photographic print medium according to claim 1 wherein said removable color-subtractive microdots are comprised of a colorant that is removed after photographic exposure of the medium to an image.

6. The copy restrictive color-negative photographic print medium according to claim 5 wherein the colorant of said removable color-subtractive microdots is a water soluble dye that is removed after exposure of the medium to an image and during photographic chemical processing.

7. The copy restrictive color-negative photographic print medium according to claim 5 wherein the colorant of said removable color-subtractive microdots is a solid particle dye that is removed after exposure of the medium to an image and during photographic chemical processing.

8. The copy restrictive color-negative photographic print medium according to claim 5 wherein the colorant of said removable color-subtractive microdots is a photobleachable dye that is removed after exposure of the medium to an image and during the subsequent exposure of the medium to ambient viewing illumination.

9. The copy restrictive color-negative photographic print medium according to claim 5 wherein the colorant of the removable color-subtractive microdots is yellow.

10. The copy restrictive color-negative photographic print medium according to claim 1 wherein the equivalent circular diameter of the removable color-subtractive microdots is 300 microns or less with the edge of a microdot defined by the isodensity profile at which the yellow optical density is midway between the maximum density of the microdot and the density of the region adjacent to the microdot.

11. The copy restrictive color-negative photographic print medium according to claim 1 wherein the spatial arrangement of the removable color-subtractive microdots is periodic with one or more periodicities.

12. The copy restrictive color-negative photographic print medium according to claim 1 wherein the spatial arrangement of the removable color-subtractive microdots is aperiodic with one or more aperiodicities.

13. The copy restrictive color-negative photographic print medium according to claim 1 wherein the spatial arrangement of the removable color-subtractive microdots is a combination of periodic and aperiodic.

14. A copy restrictive color-negative photographic print medium according to claim 1 wherein said pattern of removable color-subtractive microdots is unique.

15. The copy restrictive color-negative photographic print medium according to claim 1 wherein the removable color-subtractive microdots are minimally spaced 0.5 mm center-to-center.

16. A copy restrictive color-negative photographic print medium comprising:

a support layer;

at least one image-forming layer supported by said support layer;

a clear protective overcoat above said at least one image-forming layer; and a pattern of removable color-subtractive microdots, depth-wise positioned anywhere within said protective overcoat and said at least one image-forming layer, for causing the formation of resultant image microdots in a processed image;

wherein said resultant image microdots are substantially undetectable by casual observation under normal viewing conditions of said processed image.

17. The color-negative copy-restrictive photographic print medium according to claim 16 wherein said support layer is a reflective support.

18. The color-negative copy-restrictive photographic print medium according to claim 16 and further comprising a light-reflective layer positioned between said support layer and said at least one image-forming layers.

19. The copy restrictive color-negative photographic print medium according to claim 16 wherein said removable color-subtractive microdots are comprised of a colorant that is removed after photographic exposure of the medium to an image.

20. The copy restrictive color-negative photographic print medium according to claim 19 wherein the colorant of said removable color-subtractive microdots is a water soluble dye that is removed after exposure of the medium to an image and during photographic chemical processing.

21. The copy restrictive color-negative photographic print medium according to claim 19 wherein the colorant of said removable color-subtractive micro dots is a solid particle dye that is removed after exposure of the medium to an image and during photographic chemical processing.

22. The copy restrictive color-negative photographic print medium according to claim 19 wherein the colorant of said removable color-subtractive micro dots is a photobleachable dye that is removed after exposure of the medium to an image and during the subsequent exposure of the medium to ambient viewing illumination.

23. The copy restrictive color-negative photographic print medium according to claim 19 wherein the colorant of the removable color-subtractive microdots is yellow.

24. The copy restrictive color-negative photographic print medium according to claim 16 wherein the equivalent circular diameter of the removable color-subtractive microdots is 300 microns or less with the edge of a microdot defined by the isodensity profile at which the yellow optical density is midway between the maximum density of the microdot and the density of the region adjacent to the microdot.

25. The copy restrictive color-negative photographic print medium according to claim 16 wherein the spatial arrangement of the removable color-subtractive microdots is periodic with one or more periodicities.

26. The copy restrictive color-negative photographic print medium according to claim 16 wherein the spatial arrangement of the removable color-subtractive microdots is aperiodic with one or more aperiodicities.

27. The copy restrictive color-negative photographic print medium according to claim 16 wherein the spatial arrangement of the removable color-subtractive microdots is a combination of periodic and aperiodic.

28. A copy restrictive color-negative photographic print medium according to claim 16 wherein said pattern of removable color-subtractive microdots is unique.

29. The copy restrictive color-negative photographic print medium according to claim 16 wherein the removable color-subtractive microdots are minimally spaced 0.5 mm center-to-center.

30. A copy restrictive color-negative photographic print medium comprising:

a support layer;

at least one layer containing a recorded color image supported by said support layer;

a clear protective overcoat covering said at least one layer; and a pattern of resultant image microdots positioned in one recorded color image;

wherein said resultant image microdots are substantially undetectable by casual observation under normal viewing conditions of said color image.

31. A copy restrictive color-negative photographic print medium according to claim 30 wherein the resultant image microdots are formed as a result of the presence during image exposure of an identical pattern of removable color-subtractive microdots.

32. The copy restrictive color-negative photographic print medium according to claim 30 wherein the resultant image microdots have an optical density, size, and spacing so as to not visually modify the lightness, color balance, or tone reproduction of the image in the medium.

33. A copy restrictive color-negative photographic print medium according to claim 30 wherein the color of the resultant image microdots is minus-yellow when viewed against a yellow image background and blue in color when viewed against a neutral image background.

34. The copy restrictive color-negative medium according to claim 30 wherein said pattern of resultant image microdots is absent from areas of the image of minimal optical density.

35. The copy restrictive color-negative medium according to claim 30 wherein said resultant image microdots have a spectral character of low visual perceptibility.

36. The copy restrictive color-negative medium according to claim 30 wherein the equivalent circular diameter of the resultant image microdots is 300 microns or less with the edge of a microdot defined by the isodensity profile at which the yellow optical density is midway between the minimum density of the microdot and the density of the region adjacent to the resultant image microdot.

37. The copy restrictive color-negative photographic print medium according to claim 30 wherein the spatial arrangement of the resultant image microdots is periodic with one or more periodicities.

38. The copy restrictive color-negative photographic print medium according to claim 30 wherein the spatial arrangement of the resultant image microdots is aperiodic with one or more aperiodicities.

39. The copy restrictive color-negative photographic print medium according to claim 30 wherein the spatial arrangement of the resultant image microdots is a combination of periodic and aperiodic.

40. A copy restrictive color-negative photographic print medium according to claim 30 wherein said pattern of resultant image microdots is unique.

41. A copy restrictive color-negative photographic print medium according to claim 30 wherein said pattern of resultant image microdots can be detected by a microprocessor performing a discrete Fourier transform of the digital signal produced by a scan of the image using an electro-optical image scanner.

42. The copy restrictive color-negative medium according to claim 30 wherein the resultant image microdots are minimally spaced 0.5 mm center-to-center.

* * * * *